US005586432A

United States Patent [19]

Huemer et al.

[11] Patent Number: 5,586,432

[45] Date of Patent: Dec. 24, 1996

[54] DEVICE FOR REGULATION OF A MOTOR VEHICLE ENGINE AT IDLE SPEED

[75] Inventors: Gerhart Huemer, Neukeferloh; Heinz Lemberger, Unterfoehring, both of Germany

[73] Assignee: Bayerische Motoren Werke AG, Munich, Germany

[21] Appl. No.: 320,317

[22] Filed: Oct. 11, 1994

[30] Foreign Application Priority Data

Oct. 11, 1993 [DE] Germany ..... 43 34 557.3

[51] Int. Cl.[6] ..... F01N 3/20

[52] U.S. Cl. ..... 60/274; 60/276; 60/284; 60/285

[58] Field of Search ..... 60/274, 284, 285, 60/276

[56] References Cited

U.S. PATENT DOCUMENTS

| | | | |
|---|---|---|---|
| 2,937,490 | 5/1960 | Calvert | 60/284 |
| 3,756,205 | 9/1973 | Frost | 60/299 |
| 4,007,590 | 2/1977 | Nagai | 60/285 |
| 4,103,486 | 8/1978 | Hata | 60/285 |
| 4,134,261 | 1/1979 | Iizuka et al. . | |

FOREIGN PATENT DOCUMENTS

| | | |
|---|---|---|
| 2200891 | 4/1974 | France . |
| 2627286 | 12/1977 | Germany . |
| 3102628 | 1/1982 | Germany . |
| 4228053 | 4/1983 | Germany . |
| 2912796 | 1/1988 | Germany . |
| 57-84228 | 5/1982 | Japan . |
| 59-105941 | 6/1984 | Japan . |
| 60-088833 | 5/1985 | Japan . |
| 63-055337 | 3/1988 | Japan . |
| 63-134831 | 6/1988 | Japan . |
| 3-124907 | 5/1991 | Japan . |
| 1315627 | 6/1987 | U.S.S.R. . |

OTHER PUBLICATIONS

*Krafthand,* "1st Zylinderabschaltung sinvoll?", Sep. 29, 1984, H. 18, pp. 1454–1456.

*Technik Mot,* "AVL–Leichtdiesel: Zukunftsmuskik", Nr. 26, p. 61, Dec. 26, 1980.

*Automobile Revue,* "Programmierbarer Hubkolbenmotor von Cadillac schon ab Modelljahr 1981" by Ken Zino, Nr. 35, p. 37, Aug. 21, 1980, Glen Rock, NY.

*Kraftfahrzeugtechnik,* "Kraftstoffsparender japanischer PKW–Antrieb" by R. Friebel, 1983, H. 11, p. 337.

*Primary Examiner*—Douglas Hart

*Attorney, Agent, or Firm*—Evenson, McKeown, Edwards & Lenahan, P.L.L.C.

[57] ABSTRACT

In a device for control of a motor vehicle engine operating at idle with two rows of cylinders, having a catalytic converter with an oxygen sensor associated with each, during operation of the engine at idle the injectors of one of the two rows of cylinders are alternately switched off. This switching of the injector shut-off from one row of cylinders to the other row of cylinders always takes place when the temperature of the catalytic converter associated with the row of cylinders that has just been shut-off falls below a predetermined temperature limit. Alternatively, in a device for control of a motor vehicle engine operating at idle with only one catalytic converter and only one oxygen sensor, during operation of the engine at idle the injectors are sequentially shut-off according to a predetermined program as a function of the engine firing order. This sequential injector shut-off is suspended at least for a predetermined period of time when the temperature of the catalytic converter falls below a predetermined temperature limit.

16 Claims, 1 Drawing Sheet

DEVICE FOR REGULATION OF A MOTOR VEHICLE ENGINE AT IDLE SPEED

BACKGROUND AND SUMMARY OF THE INVENTION

The invention relates to a device for operation of a motor vehicle engine at idle speed. The engine includes two rows of cylinders, with a catalytic converter and oxygen sensor associated with each row. The invention also relates to a device for control of a motor vehicle engine with a catalytic converter and an oxygen sensor operating at idle speed.

A device is already known for turning off the motor vehicle's engine while it is stopped, even during a brief stop by the motor vehicle. This known device is frequently referred to as a "start-stop automatic." With this "start-stop automatic," all of the cylinders of the engine are switched off when the engine is shut-off. This has the disadvantage that the catalytic converter or converters of the engine cools very rapidly and, consequently, after the engine is started, the catalytic converter must be brought back to the necessary conversion temperature by appropriately enriching the intake mixture of the engine. However, the enriching of the mixture has a negative effect on exhaust emissions and on fuel consumption.

On the other hand, when the engine is operated with the vehicle at rest at idle, with all of the cylinders firing, critical thermal behavior can result if the amount of heat generated by combustion cannot be carried away by the coolant for lack of an air stream, particularly in large-volume multicylinder engines.

Therefore, there is needed to provide a device of the above-described type by which the fuel consumption of the engine at idle speed is reduced, while still retaining the exhaust quality. Consequently, the thermal behavior of the engine is improved.

These needs are met according to the present invention in a first embodiment of a device for idle control of a vehicle engine having two rows of cylinders, a catalytic converter and an oxygen probe associated with each row, by virtue of the fact that during operation of the engine at idle the injectors of one of the two rows of cylinders are alternately shut-off and the injector shut-off is switched from one row of cylinders to the other when the temperature of the catalytic converter associated with the row of cylinders that has just been shut-off falls below a preset temperature limit.

This first embodiment of the invention is especially suitable for eight- to twelve-cylinder internal combustion engines having a v-shaped arrangement of cylinders. The arrangement can consist of two four-cylinder or two six-cylinder engines depending on their firing order. Especially in a twelve-cylinder internal combustion engine of this design, no significant deterioration of idle quality occurs because of the complete balancing of masses of a row of cylinders.

According to a second embodiment of the present invention, the needs are met by a device for control of a motor vehicle engine at idle with a catalytic converter and oxygen sensor. During operation of the engine at idle, the injectors are switched off sequentially as a function of the engine firing order according to a fixed program, and the sequential injector shut-off is suspended at least for a specified period of time if the temperature of the catalytic converter falls below a preset temperature limit.

This second embodiment of the invention is also suitable for six-cylinder engines.

Each of the two embodiments of the present invention ensures that the catalytic converter or converters cannot cool below the temperature required for proper exhaust conversion. This results in improved engine exhaust emissions. Consequently, by shutting-off individual cylinders when the engine is idling, its fuel consumption at idle can be reduced by about 35%. Finally, the thermal behavior, especially in large volume engines at idle, when the cooling effect of the air stream is absent, is definitely improved by the present invention.

It is a further advantage of the present invention that the sequential shut-off of the injectors or the alternate switching of the injectors of one row of cylinders during operation of the engine at idle takes place only when the coolant temperature of the engine is above 80° C. and/or the air temperature in the intake manifold is above 20° C. This ensures that individual cylinder shut-off at idle operation of the engine takes place only when the engine is at operating temperature and/or the outside temperature is sufficiently warm.

In order to avoid an unpleasant torque surge at the output from the engine when parking or slowly coasting, according to another embodiment of the invention, the sequential shut-off of the injectors or the alternate shut-off of the injectors in one row of cylinders is suspended when the vehicle speed exceeds 5 km/h.

In another advantageous embodiment of the invention, the temperature of the catalytic converter or converters is determined by measuring or monitoring the electrical voltage of the oxygen sensor associated with the catalytic converter in question.

The two embodiments of the present invention will now be described with reference to an embodiment of each.

Other objects, advantages and novel features of the present invention will become apparent from the following detailed description of the invention when considered in conjunction with the accompanying drawings.

DETAILED DESCRIPTION OF THE DRAWINGS

Figure 1:
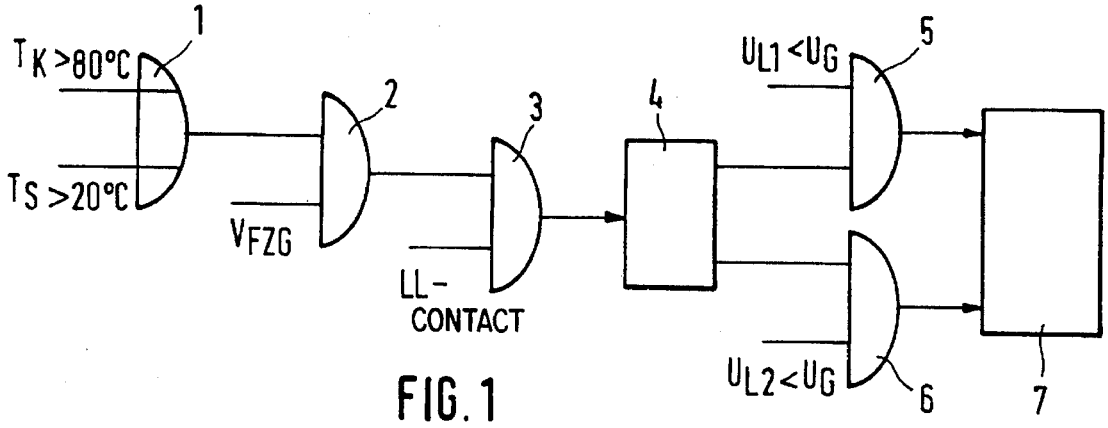
FIG. 1 is a schematic logic diagram showing the logic circuit for switching the cylinder rows according to the present invention.

The logic diagram in FIG. 1 shows the operation of a first embodiment of the present invention. The device according to this first embodiment is suitable for idle control of a motor vehicle engine. The engine has two rows of cylinders, each row having one catalytic converter with an oxygen sensor associated with it. In this embodiment, OR gate 1 receives as input parameters the information as to whether coolant temperature $T_K$ is greater than 80° C., as well as additional information as to whether air temperature $T_S$ in the intake manifold of the engine is above 20° C.

With an engine at operating temperature and without extreme ambient winter temperatures, OR gate 1 delivers a release signal to a first AND gate 2. This first AND gate 2 receives as an additional input parameter, the information as to whether speed $V_{FZG}$ of the motor vehicle is below 5 km/h.

In the event that speed $V_{FZG}$ of the vehicle is below 5 km/h, first AND gate 2 delivers a logical "1" signal to the second AND gate 3.

With the idle contact closed, second AND gate 3 receives at its second input another logical "1" signal. Then all the preconditions are met that make it possible, with the engine running at idle, for the injectors of one of the two rows of cylinders to be shut-off. This result is stored in storage element 4 until any change occurs. Storage element 4 delivers this information to the two subsequent AND gates 5 and 6. While AND gate 5 obtains at its second input the information about voltage $U_{L1}$ of the first oxygen sensor of the first catalytic converter, AND gate 6 receives at its second input the information about voltage $U_{L2}$ of the second oxygen sensor of the second catalytic converter. In the event the voltage $U_{L1}$ of the first oxygen sensor of the first catalytic converter drops below a limiting value $U_G$ because of the cooling of the first catalytic converter, this means that the row of cylinders associated with this first catalytic converter has to be switched on again and hence the row of cylinders that was previously fired, associated with the second catalytic converter, can be shut-off. However, if after a certain shut-off time the second catalytic converter associated with the row of cylinders that is now shut-off has cooled off so much that voltage $U_{L2}$ of the second oxygen sensor of the second catalytic converter falls below a limiting value $U_G$, then the row of cylinders associated with the second catalytic converter must be fired again, while the row of cylinders associated with the first catalytic converter can be shut-off again.. This alternate shut-off of the injectors of one of the two rows of cylinders during operation of the engine at idle is performed by engine control device 7, shown schematically.

Figure 2:
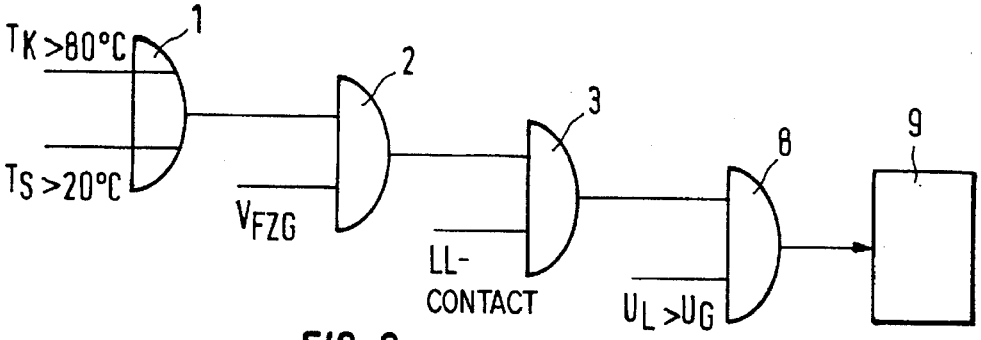
FIG. 2 is a schematic logic diagram showing the switching logic for sequential injector shut-off.

The logic diagram in FIG. 2 is identical to the logic diagram of FIG. 1 as far as the first three logical gates 1, 2, and 3 are concerned. Likewise, in the embodiment shown in FIG. 2, AND gate 3 delivers a logical "1" signal to AND gate 8 when coolant temperature $T_K$ is above 80° C. and/or air temperature $T_S$ in the intake manifold of the engine is above 20° C. and the vehicle speed $V_{FZG}$ is also below 5 km/h, and finally the engine is being operated at idle, i.e. the idle contact is closed. This AND gate 8 receives at its second input, the information as to whether electrical voltage $U_L$ from the oxygen sensor of the catalytic converter is above or below a limiting voltage $U_G$. As long as the voltage $U_L$ from the oxygen sensor is above the limiting voltage $U_G$, the injectors can be shut-off sequentially during operation of the engine at idle, depending on the engine firing order according to a predetermined program. However, if the voltage of oxygen sensor $U_L$ drops below limiting value $U_G$, this means that the catalytic converter has already cooled off to the minimum necessary limiting temperature required for its proper conversion, and consequently sequential injector shut-off must be suspended for at least a predetermined period of time. It is only after the catalytic converter has again reached a sufficiently high operating temperature, i.e., when the electrical voltage $U_L$ of the oxygen sensor is again above the limiting voltage $U_G$, that the injectors can then be shut-off sequentially once more. Sequential shut-off of the injectors of the engine is then performed by the engine control device 9.

Figure 3:
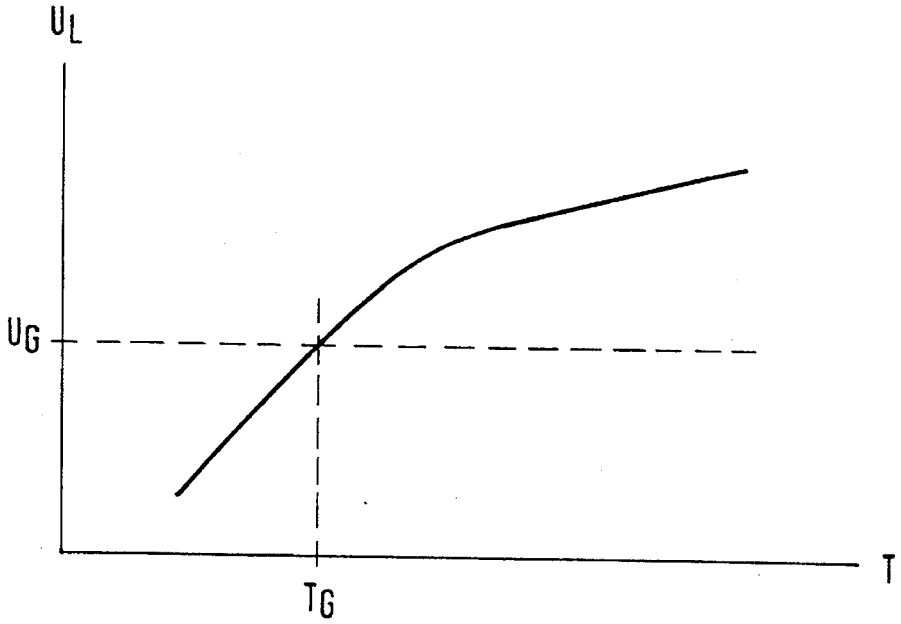
FIG. 3 is a graphical diagram showing the temperature dependence of the electrical voltage of the oxygen sensor of a catalytic converter.

In the graphical diagram shown in FIG. 3, the relationship between electric voltage $U_L$ of the oxygen sensor is shown as a function of temperature T of the corresponding catalytic converter. As indicated in the diagram in FIG. 3, the electrical voltage $U_L$ of the oxygen sensor decreases directly with the temperature T of the catalytic converter. The limiting temperature $T_G$ plotted in the graph in FIG. 3 represents the minimum temperature that the catalytic converter must have for proper operation. This limiting temperature $T_G$ in the graph corresponds to a limiting voltage $U_G$. If, due to one row of cylinders being shut-off, the corresponding catalytic converter cools off below the operating temperature $T_G$ or if the single catalytic converter of the engine cools below the operating temperature $T_G$ because of a sequential shut-off of the injectors that has lasted too long, then the electrical voltage $U_L$ of the corresponding oxygen sensor drops below the limiting value $U_G$. Because of this relationship, voltage $U_L$ of the oxygen sensor can be used as a measure of the temperature of the corresponding catalytic converter, so that a separate temperature sensor can be omitted.

By virtue of the shut-off of individual injectors during operation of the engine at idle according to the present invention, a reduction in fuel consumption as well as an improvement in thermal behavior of the engine is achieved, while retaining a high exhaust quality.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A device for operating a motor vehicle engine at idle, said engine having two rows of cylinders, and a catalytic converter and an oxygen sensor operatively associated with each of said two rows, the device comprising:

means for alternately shutting-off injectors of one of said two rows of cylinders during idle operation of the engine when a temperature (T) of the associated catalytic converter is above a predetermined temperature limit ($T_G$); and means for switching an injection valve shut-off from one row of cylinders to the other row of cylinders when the temperature (T) of said catalytic converter associated with said row of cylinders having just been shut-off falls below the predetermined temperature limit ($T_G$).

2. A device according to claim 1, wherein said alternate shut-off means of the injectors in one row of cylinders during operation of the engine at idle takes place only when at least one of a coolant temperature ($T_K$) of the engine is above 80° C. and an air temperature ($T_S$) in an intake manifold of the engine is above 20° C.

3. A device according to claim 1, wherein said alternate shut-off of the injectors of one row of cylinders is suspended only at vehicle speeds ($F_{FZG}$) above 5 km/h.

4. A device according to claim 2, wherein said alternate shut-off of the injectors of one row of cylinders is suspended only at vehicle speeds ($F_{FZG}$) above 5 km/h.

5. A device according to claim 1, wherein-the temperature (T) of the catalytic converter is determined by one of measuring and monitoring the electrical voltage ($U_L$) of the oxygen sensor associated with the catalytic converter.

6. A device according to claim 2, wherein the temperature (T) of the catalytic converter is determined by one of measuring and monitoring the electrical voltage ($U_L$) of the oxygen sensor associated with the catalytic converter.

7. A device according to claim 3, wherein the temperature (T) of the catalytic converter is determined by one of measuring and monitoring the electrical voltage ($U_L$) of the oxygen sensor associated with the catalytic converter.

8. A device for controlling a motor vehicle engine operating at idle with a catalytic converter and an oxygen sensor, comprising:

means for sequentially switching-off injectors of said engine depending on an engine firing order according to a predetermined program when a temperature (T) of the associated catalytic converter is above a predetermined temperature limit ($T_G$); and means for suspending the operation of said sequential switching-off means for a predetermined period of time when the temperature of said catalytic converter falls below the predetermined temperature limit.

9. A device according to claim 8, wherein said sequential switching-off means of the injectors in one row of cylinders during operation of the engine at idle takes place only when at least one of a coolant temperature ($T_K$) of the engine is above 80° C. and an air temperature ($T_S$) in an intake manifold of the engine is above 20° C.

10. A device according to claim 8, wherein said sequential switching-off of the injection valves of the injectors of one row of cylinders is suspended only at vehicle speeds ($F_{FZG}$) above 5 km/h.

11. A device according to claim 9, wherein said sequential switching-off of the injection valves of the injectors of one row of cylinders is suspended only at vehicle speeds ($F_{FZG}$) above 5 km/h.

12. A device according to claim 8, wherein the temperature (T) of the catalytic converter is determined by one of measuring and monitoring the electrical voltage ($U_L$) of the oxygen sensor associated with the catalytic converter.

13. A device according to claim 9, wherein the temperature (T) of the catalytic converter is determined by one of measuring and monitoring the electrical voltage ($U_L$) of the oxygen sensor associated with the catalytic converter.

14. A device according to claim 10, wherein the temperature (T) of the catalytic converter is determined by one of measuring and monitoring the electrical voltage ($U_L$) of the oxygen Sensor associated with the catalytic converter.

15. A method for operating a motor vehicle engine at idle, said engine having two rows of cylinders, and a catalytic converter and an oxygen sensor operatively associated with each of said two rows, the device comprising:

alternately shutting-off injectors of one of said two rows of cylinders during idle operation of the engine when a temperature (T) of the associated catalytic converter is above a predetermined temperature limit ($T_G$); and switching an injection valve shut-off from one row of cylinders to the other row of cylinders when the temperature (T) of said catalytic converter associated with said row of cylinders having just been shut-off falls below the predetermined temperature limit ($T_G$).

16. A method for controlling a motor vehicle engine operating at idle with a catalytic converter and an oxygen sensor, comprising:

sequentially switching-off injectors of said engine depending on an engine firing order according to a predetermined program when a temperature (T) of the associated catalytic converter is above a predetermined temperature limit ($T_G$); and suspending the operation of said sequential switching-off means for a predetermined period of time when the temperature of said catalytic converter falls below the predetermined temperature limit.

* * * * *